US005562332A

United States Patent [19]

Stacy

[11] Patent Number: 5,562,332

[45] Date of Patent: Oct. 8, 1996

[54] LOBBY TABLE FOR LOCKABLE BOXES WITH HANDICAPPED SHELF

[75] Inventor: George F. Stacy, Tarpon Springs, Fla.

[73] Assignee: HSS Industries, Inc., Traverse, Mich.

[21] Appl. No.: 363,890

[22] Filed: Dec. 27, 1994

[51] Int. Cl.[6] ..... A47B 87/00

[52] U.S. Cl. ..... 312/107; 312/198; 312/348.1; 312/194; 312/257.1; 312/265.4; 312/265.5; 312/348.2; 312/348.4; 206/509; 232/17; 232/38; 232/24; 108/91

[58] Field of Search ..... 312/107, 108, 312/109, 194, 195, 198, 257.1, 263, 265.1, 265.4, 265.5, 348.1, 348.2, 348.3, 348.4, 140.1, 203, 277, 140; 232/17, 19, 21, 38, 39; 206/509; 108/91, 107

[56] References Cited

U.S. PATENT DOCUMENTS

| | | | |
|---|---|---|---|
| 1,245,022 | 10/1917 | Piggot | 312/198 |
| 1,983,307 | 12/1934 | Regenhardt | 312/257.1 X |
| 2,063,725 | 12/1936 | Clark | 312/107 |
| 2,563,094 | 8/1951 | Becker | 232/24 |
| 2,694,614 | 11/1954 | Dent | 312/198 X |
| 2,987,356 | 6/1961 | Simpson, Jr. | 312/198 X |
| 3,070,234 | 12/1962 | Deitchman | 108/107 X |
| 3,625,581 | 12/1971 | Frederick | 312/198 |
| 4,055,373 | 10/1977 | Andresen et al. | 312/198 X |
| 4,109,981 | 8/1978 | Pfaehler | 312/107 |
| 4,121,758 | 10/1978 | Bonner | 232/17 |
| 4,173,379 | 11/1979 | van der Heiden et al. | 312/348.1 |
| 4,258,963 | 3/1981 | Fusselman et al. | 312/194 |
| 5,123,533 | 6/1992 | Uitz | 206/509 X |
| 5,267,688 | 12/1993 | Benefield | 232/17 |
| 5,435,255 | 7/1995 | Elseser et al. | 312/257.1 X |

FOREIGN PATENT DOCUMENTS

| | | | |
|---|---|---|---|
| 2651422 | 3/1991 | France | 232/38 |
| 2143429 | 2/1985 | United Kingdom | 312/194 |

*Primary Examiner*—Peter M. Cuomo
*Assistant Examiner*—Rodney B. White
*Attorney, Agent, or Firm*—Ian C. McLeod; Mary M. Moyne

[57] ABSTRACT

A lobby table (10) for use in a post office lobby is described. The lobby table has lockable boxes (14) which are mounted together and spaced apart by front and back horizontal spacers (64 and 66). A counter top (12) is mounted on the uppermost horizontal row of lockable boxes and is supported by the underlying lockable boxes. The lockable boxes have a top wall (14A), a bottom wall (14B) and two sidewalls (14C) which form a front opening (14D) which allows access to the interior of the lockable box. The perimeter of the front opening is surrounded by a frame (30) formed by a top frame member (32), a bottom frame member (34), a right frame member (36) and a left frame member (38). The lockable box can also be provided with a central wall and a center frame member (42) in order to provide right and left small boxes (24 and 26). The frame members add aesthetic qualities to the front of the lobby table as well as providing mounting support for the doors (48 and 50) and support for the side panels (76) of the lobby table. Vertical T-moldings (60) which are inserted between the flanges (36A and 38B) of the right and left frame members also add aesthetic qualities to the lobby table. The lobby table is supported by a base (70) having a bottom panel (72) and a pedestal (74). The bottom panel is spaced from the lowermost horizontal row of lockable boxes by horizontal spacers. The back openings of the lockable boxes is covered by a back panel which slides under the back flanges (76D) of the side panels. The lobby table also has a side desk (78) which has a desk top (80) supported on a support shell (82). The support shell consists of an outer leg and a back which act together with one of the side panels of the lobby table to form an open front. The desk top of the side desk is spaced below the counter top of the lobby table in order to enable handicap persons in a wheelchair to use the desk top.

17 Claims, 5 Drawing Sheets

LOBBY TABLE FOR LOCKABLE BOXES WITH HANDICAPPED SHELF

BACKGROUND OF THE INVENTION (1) Field of the Invention

The present invention relates to a lobby table for use in a post office lobby. In particular, the invention relates to a lobby table having a counter top with underlying lockable boxes which are used to receive various sized and amounts of mail including parcels and letters. The counter top is supported by vertically adjacent horizontal rows of lockable boxes which are mounted together using horizontal spacers. The lobby table also includes a side desk having a desk top which is lower to the ground than the counter top of the lobby table. The lower desk top of the side desk allows the side desk to be used by handicap persons especially those in a wheelchair.

(2) Description of Related Art

The prior art has shown various types of cabinets containing mailboxes. The prior art cabinets however were usually constructed using a structural framework into which mailboxes were mounted. Thus, the support for the cabinet was due to the framework rather than the mailboxes. This construction required that an entirely new structural framework was needed wherever a different configuration of mailboxes was needed. This requirement greatly limited the versatility of the cabinet and also made specialized cabinets very expensive to construct. In addition, the mailbox cabinets of the prior art were not usually able to be used as a counter top especially one which has a special area to accommodate individuals who are in a wheelchair. Therefore, there remains a need for a mailbox cabinet which can be easily modified to vary the size, amount or specific location of the mailbox, which can be used as a lobby table and which includes a special desk for handicap persons.

OBJECTS

It is therefore an object of the present invention to provide a lobby table which has lockable boxes which are able to receive various sized and amounts of mail including parcels and letters. Further, it is an object of the present invention to provide a lobby table which has a side desk which is able to be used by handicap persons especially those in a wheelchair. Still further, it is an object of the present invention to provide a lobby table which has a counter top directly supported by underlying horizontal rows of lockable boxes. Furthermore, it is an object of the present invention to provide a lobby table having lockable boxes where the size and number of lockable boxes comprising the lobby table can be varied in order to allow the lockable boxes to receive different sizes and shapes of mail. Finally, the present invention relates to a lobby table in which the lockable boxes are mounted together in parallel horizontal rows spaced apart by horizontal spacers.

DETAILED DESCRIPTION OF THE PREFERRED EMBODIMENTS

Figure 1:
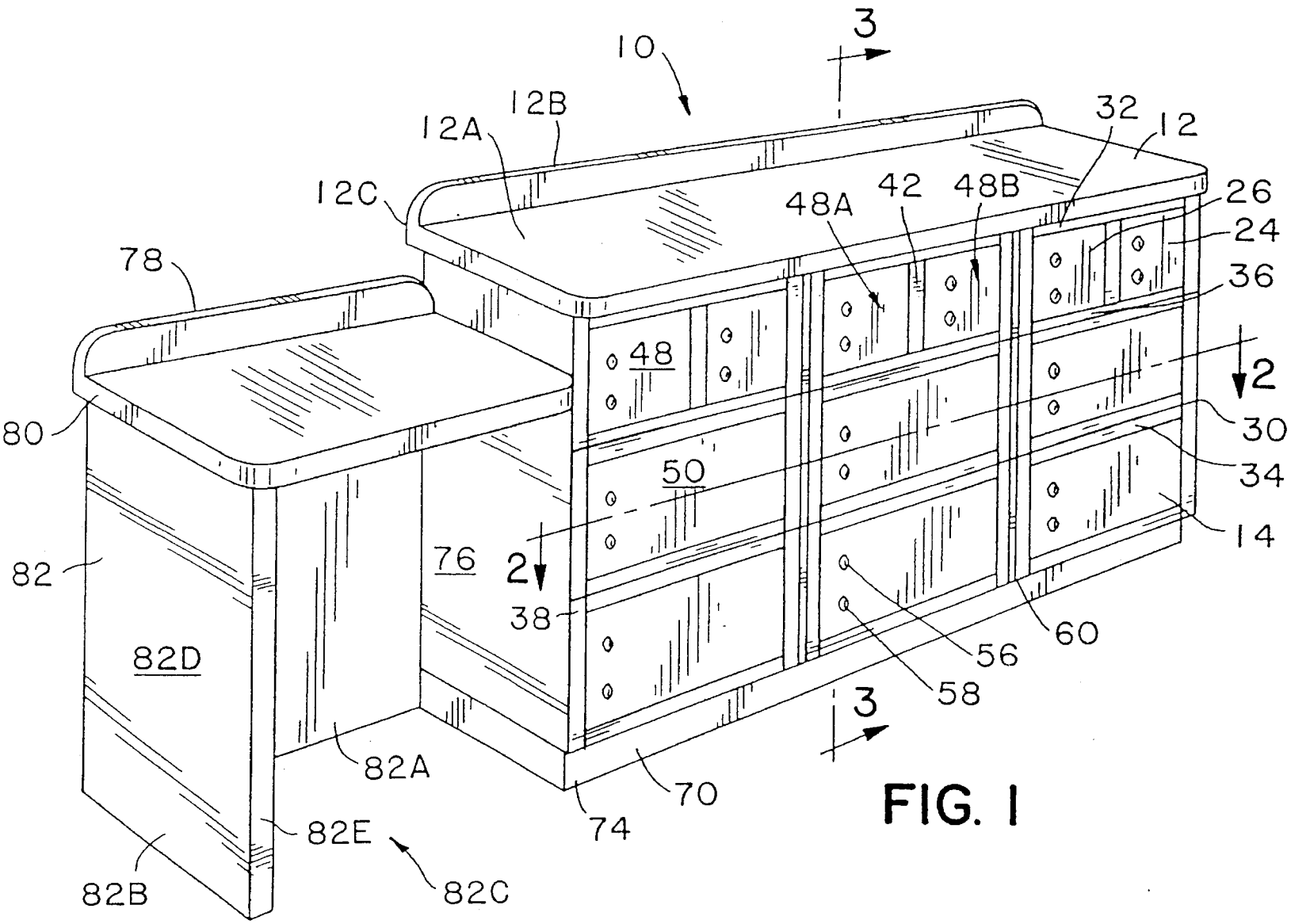
FIG. 1 is a front perspective view of the lobby table 10 of the present invention.

The present invention relates to a lobby table having a top, a bottom and two opposed sides for use in a post office lobby, which comprises: lockable boxes each having a top wall and a bottom wall with two sidewalls therebetween forming a rectangular opening spaced between a front opening and a back opening and with a frame means mounted around the front opening of each of the lockable boxes wherein the lockable boxes are positioned in horizontal rows and in vertical rows positioned one above the other; horizontally oriented spacers mounted between each of the vertically adjacent horizontal rows of the lockable boxes and secured to the top wall and the bottom wall of the lockable boxes with a first spacer adjacent the front opening and a second spacer adjacent the back opening of each of the lockable boxes; vertically oriented moldings mounted between the vertical rows of each of the horizontally adjacent lockable boxes; lockable door means mounted adjacent the front opening of each of the lockable boxes for allowing closing of the front opening of each of the lockable boxes; a counter top means mounted adjacent the top wall of an uppermost horizontal row of the lockable boxes at a height which enables the table to be used as a desk; a base means mounted adjacent the bottom wall of a lowermost horizontal row of the lockable boxes for supporting the lockable boxes above a ground surface; and a back panel means mounted adjacent the back openings of each of the lockable boxes for closing the back openings of each of the lockable boxes.

In particular, the present invention relates to a method for manufacturing a lobby table having a top, a bottom and two opposed sides, which comprises: providing lockable boxes each having a top wall and a bottom wall with two sidewalls therebetween forming a rectangular opening spaced between a front opening and a back opening and having a frame means mounted around the front opening of each of the lockable boxes, horizontally oriented spacers, lockable door means mounted on the frame means for allowing closing of the front opening of each of the lockable boxes, a counter top means having a top surface and a bottom surface with a front edge and a back edge and two ends extending therebetween for enabling the cabinet to be used as a desk, a base means for supporting the lockable boxes above a ground surface, a back panel means for closing the back openings of the lockable boxes; positioning the counter top means with the bottom surface facing upwards; mounting the top wall of an uppermost row of the lockable boxes on the bottom surface of the counter top means so that the front opening of the lockable boxes is adjacent the front edge of the counter top means; securing horizontally oriented spacers on the bottom wall of the uppermost row of the lockable boxes opposite the counter top means; mounting at least two horizontal rows of the lockable boxes spaced apart by horizontally oriented spacers with the top wall of an adjacent horizontal row of the lockable boxes on the horizontally oriented spacers opposite the lockable boxes of the uppermost row, wherein the front opening of the lockable boxes of the uppermost row is adjacent the front opening of the lockable boxes of the adjacent horizontal rows; and mounting the base means on the bottom wall of the lockable boxes of a lowermost row; and mounting the back panel adjacent the back opening of the lockable boxes for closing the back opening of the lockable boxes.

The lobby table includes a desk means which has a desk top means, an outside leg and a back wall which form an open front to enable a handicap user in a wheelchair to move a portion of the wheelchair under the desk top means in order to use the desk top means.

The horizontal spacers are U-shaped with a long leg mounted adjacent the bottom wall of one horizontal row of lockable boxes and a short leg adjacent the top wall of an adjacent horizontal row. The boxes, the spacers and the moldings are constructed of steel.

FIGS. 1 to 4 show the lobby table 10 of the present invention. The lobby table 10 includes lockable boxes 14 which are mounted together by horizontal spacers 64 and 66 and which support a counter top 12. The lobby table 10 also includes a side desk 78 which allows the lobby table 10 to be used by handicap persons (not shown) especially those in a wheelchair.

Figure 3:
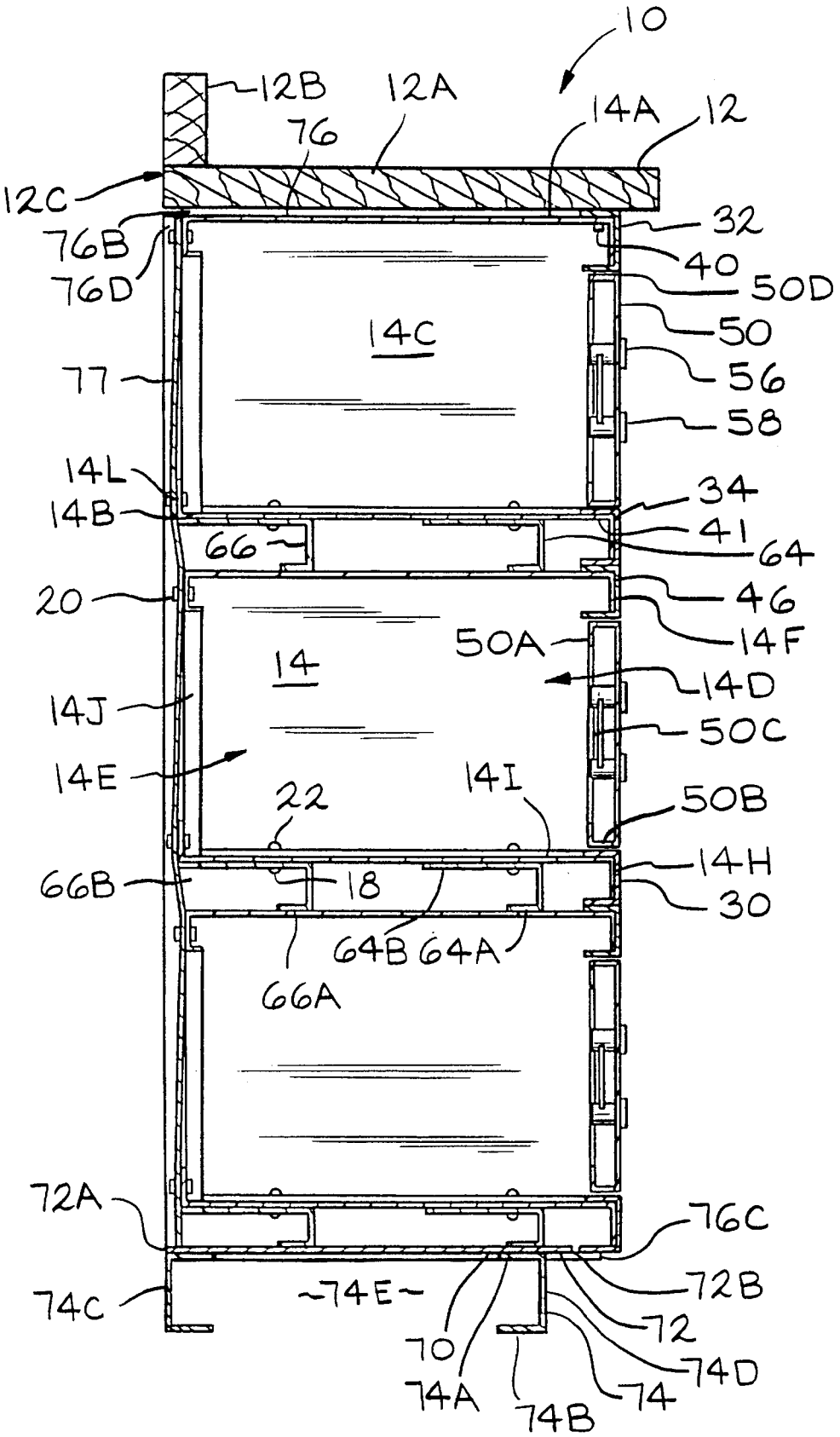
FIG. 3 is a vertical cross-section of the lobby table 10 along line 3—3 of FIG. 1 showing the counter top 12, the horizontal spacers 64 and 66, the back panel 77, the locks 56 and 58, the doors 50, the bottom panel 72 of the base 70.
Figure 4:
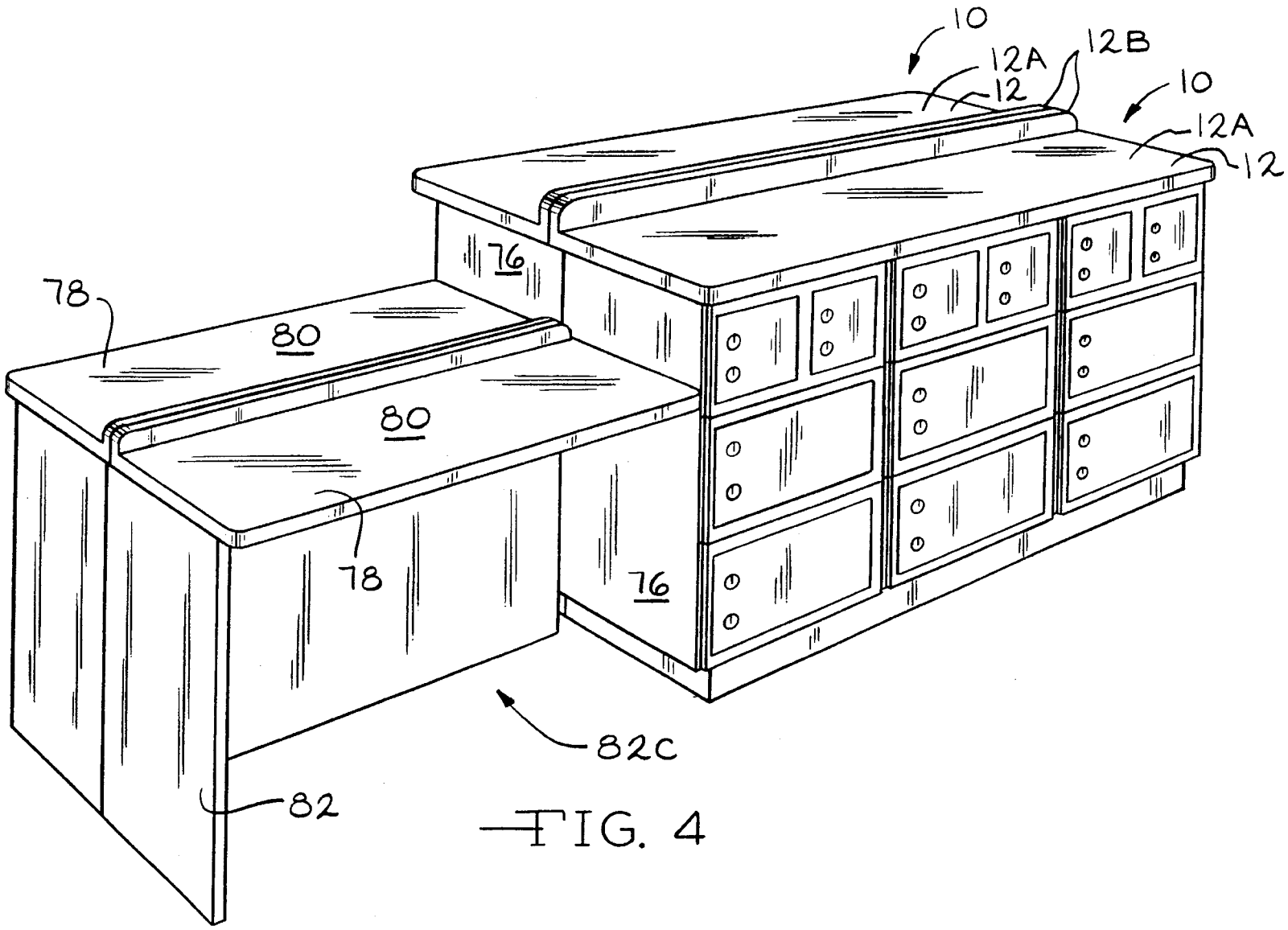
FIG. 4 is a perspective view of two lobby tables 10 positioned back to back.

As shown in FIG. 3, the counter top 12 has a flat top 12A and a back stop 12B and is mounted adjacent the top wall 14A of the lockable boxes 14 which comprise the uppermost horizontal row of lockable boxes 14 (to be described in detail hereinafter). The back stop 12B is mounted on the flat top 12A at the back edge 12C of the counter top 12 and extends upward such as to form a 90° angle with the flat top 12A of the counter top 12 (FIG. 3). Preferably the flat top 12A and the back stop 12B are constructed from two separate pieces which are fastened together. The counter top 12 is preferably 1.5 inches (3.7 cm) thick. The exact size of the counter top 12 depends on the length and width of the underlying lockable boxes 14. In the preferred embodiment, the counter top 12 has a size such as to extend beyond the front openings 14D of the underlying lockable boxes 14 and the side panels 76 of the lobby table 10 such as to form an overhang. Preferably, the back edge 12C of the counter top 12 is flush with the back panel 77 of the lobby table 10 such that the lobby table 10 is able to be placed closely adjacent a wall (not shown) or alternately two lobby tables 10 may be located back to back (FIG. 4). The overhang of the counter top 12 increases the aesthetic quality of the lobby table 10 and also decreases the possibility of injury due to contact with a sharp, uncovered top edge or corner of the lockable boxes 14. The counter top 12 has rounded corners which also adds to the aesthetic quality of the lobby table 10 and also reduces the potential for injury due to sharp corners. The counter top 12 of the lobby table 10 is preferably constructed of a high pressure laminated particle board.

Figure 2:
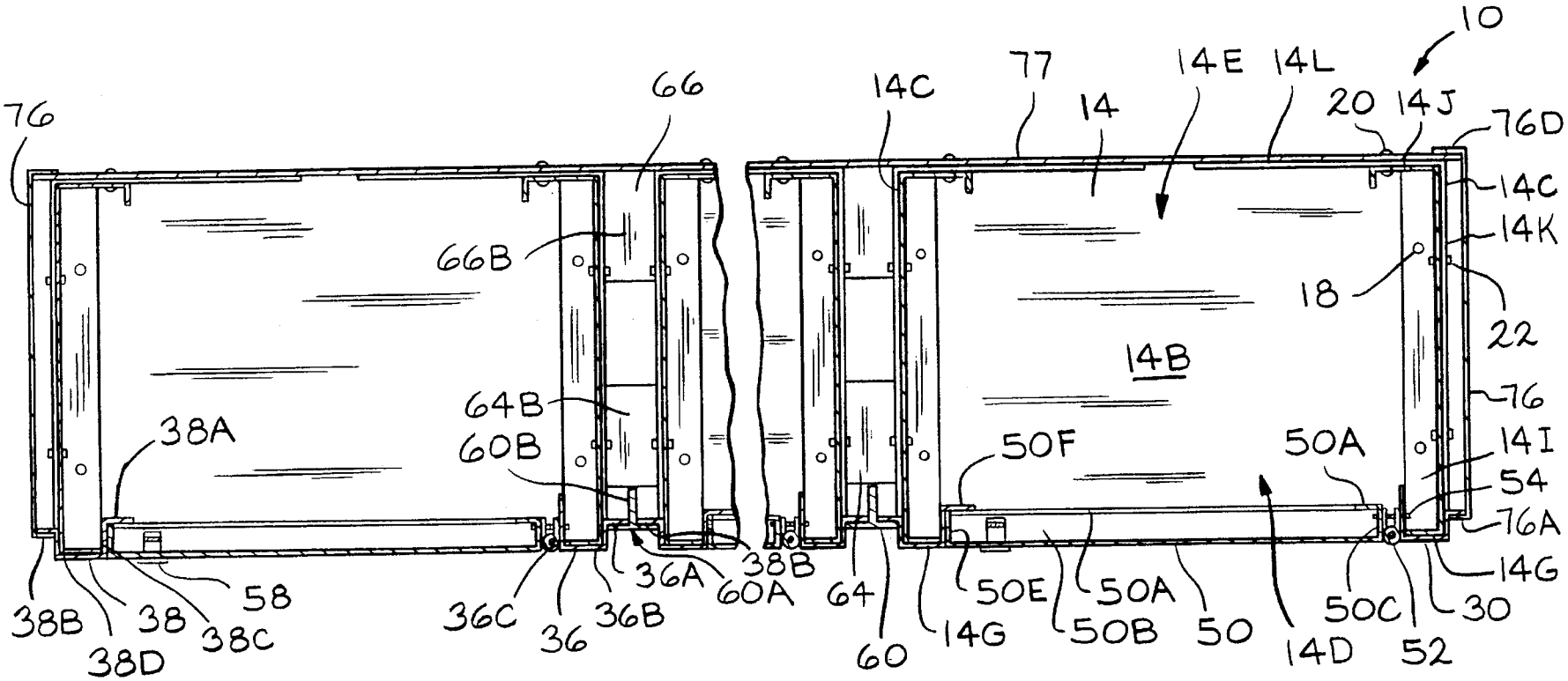
FIG. 2 is a horizontal cross-section of the lobby table 10 of FIG. 1 along the line 2—2 showing the horizontal spacers 64 and 66, the right and left frame members 36 and 38, the T-shaped moldings 60, the side walls 14C of the lockable boxes 14, the doors 50, the hinge 52 and the back panel 77 and side panels 76 of the lobby table 10.
Figure 5:
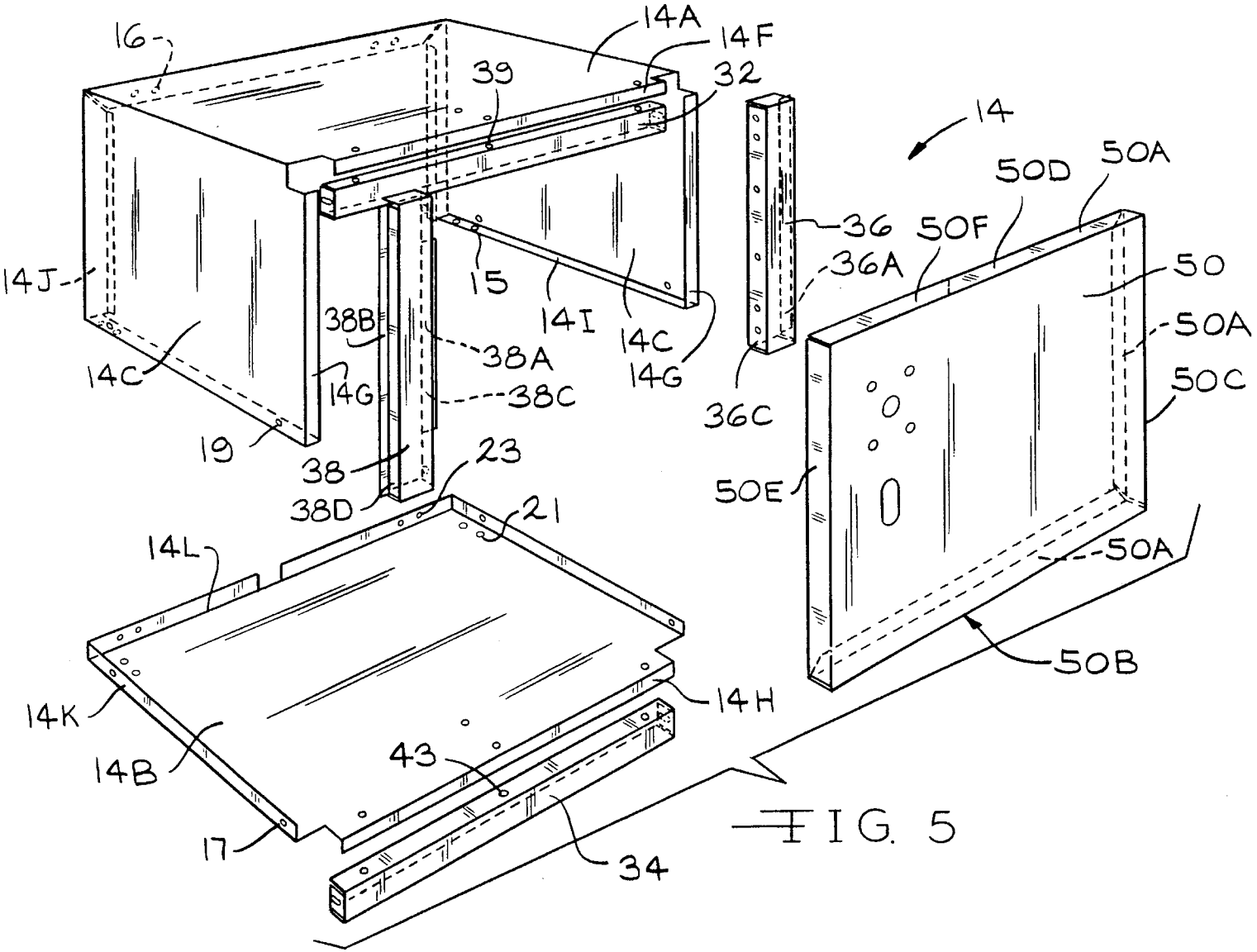
FIG. 5 is an exploded, perspective view of the lockable box 14 showing the top wall 14A, the bottom wall 14B, the two opposed side walls 14C, the top, bottom, right and left frame members 32, 34, 36 and 38 which mount over the top, bottom and side front flanges 14F, 14H and 14G, respectively, and door 50.

The lockable boxes 14 of the lobby table 10 each have a top wall 14A, a bottom wall 14B and two opposed side walls 14C which form a front opening 14D and a back opening 14E allowing access to the interior of the lockable box 14 (FIGS. 2 and 3). Preferably, the top wall 14A and the two opposed side walls 14C are constructed as a unitary piece (FIG. 5). The top wall 14A and the side walls 14C are provided with a top front flange 14F and side front flanges 14G, respectively, adjacent the front opening 14D of the lockable box 14. The top and side front flanges 14F and 14G extend perpendicular to the top wall 14A or side walls 14C, respectively, and into the front opening 14D of the lockable box 14. The upper corners of the lockable box 14 including the intersections of the top and side front flanges 14F and 14G are cut away about 0.875 inches (2.4 cm) down and 0.75 inches (1.8 cm) inward (FIG. 5). The upper corners of each of the lockable boxes 14 are cut out in order to enable the top, left and right frame members 32, 38 and 36 (to be described in detail hereinafter) to be mounted over the top and side front flanges 14F and 14G of the lockable boxes 14. Each of the side walls 14C of the box 14 are also provided with a lower flange 14I which extends inward perpendicular to the side wall 14C into the interior of the lockable boxes 14 (FIG. 2). The lower flanges 14I have holes 15 for rivets 18 to fasten the lockable boxes 14 onto horizontal spacers 64 and 66 through the bottom wall 14B of the lockable boxes 14. The top wall 14A and the side walls 14C as a unitary piece, are provided with an L-shaped back flange 14J adjacent the back opening 14E of the lockable box 14 (FIGS. 2 and 3). The L-shaped back flange 14J is provided with holes 16 for rivets 20 to fasten the back panel 10B of the lobby table 10 onto the lockable boxes 14.

The bottom wall 14B of each of the lockable boxes 14 fits onto the side walls 14C of the lockable box 14 opposite the top wall 14A. The bottom wall 14B has bottom side flanges 14K and a bottom back flange 14L which extend upward perpendicular to the bottom wall 14B adjacent the side walls 14C and into the back opening 14E, respectively, of the lockable box 14 (FIGS. 2 and 3). Preferably, the bottom wall 14B is of such a size such that the flanges 14K and 14L fit adjacent the outside surface of the side walls 14C and L-shaped back flanges 14J. The bottom wall 14B of each of the lockable boxes 14 is provided with a bottom front flange 14H adjacent the front opening 14D of the lockable box 14. The bottom front flange 14H extends downward perpendicular to the bottom wall 14B of the box 14 toward the top wall 14A of the next lower, vertically adjacent box 14. The front corners of the bottom wall 14B are cut out to enable the left, right and bottom frame members 38, 36 and 34 to be mounted over the bottom and side front flanges 14G and 14H of the lockable boxes 14 (FIG. 5). In the preferred embodiment, the front flanges 14F, 14G and 14H of all the walls 14A, 14B and 14C of the lockable box 14 are the same size and allow for mounting of uniform frame members 32, 34, 36 and 38 around the front opening 14D of the box 14. The side flanges 14K of the bottom wall 14B are preferably provided with holes 17 which correspond to holes 19 in the side walls 14C of the lockable boxes 14 for rivets 22 to fasten the bottom wall 14B onto the side walls 14C. The bottom wall 14B is also preferably provided with holes 21 which correspond to the holes 15 in the lower flanges 14I of the side walls 14C for rivets 18 to secure the lockable boxes 14 onto the horizontal spacers 64 and 66. Finally, the back flange 14L of the bottom wall 14B has holes 23 which correspond to holes 16 in the L-shaped back flange 14J of the top and side walls 14A and 14C for rivets 20 to fasten the back panel 77 onto the lockable boxes 14.

When the lockable box 14 is divided to create a right and left small box 24 and 26, a center wall (not shown) is mounted in the interior of the lockable box 14 between the front and back openings 14D and 14E, parallel to the side walls 14C of the lockable box 14. Preferably, the center wall is mounted in the center of the lockable box 14 and extends completely from the top wall 14A to the bottom wall 14B of the lockable box 14. In the preferred embodiment, the center wall is hollow with a three-dimensional, rectangular shape and is mounted in the interior of the lockable box 14 by rivets (not shown) which extend through the top and bottom wall 14A and 14B of the lockable box 14. The thickness of the center wall is preferably the same as the thickness of the front flanges 14F, 14G and 14H of the top, bottom and side walls 14C of the lockable boxes 14. This ensures that the center member 42 (to be described in detail hereinafter) is the same size as the other frame members 32, 34, 36 and 38. In the preferred embodiment, the lockable boxes 14 all have an identical height of 11.9375 inches (30.4 cm). The length of the boxes 14 varies depending on the size of the parcels or letters to be delivered into the box 14. The small boxes 24 and 26 are preferably of such a size as to receive large amounts of letters and small parcels (not shown) while the regular sized box 14 can receive large amounts of letters and large parcels. The height and length of the lockable boxes 14 can be varied depending upon the particular use of the lobby table 10 (i.e. amounts and size of letters and parcels to be received) and the overall size of the lobby table 10. Preferably, the particular height and length of each of the boxes 14 is a multiple of the height and length, respectively of the small boxes 24 and 26. This proportional sizing allows the lobby table 10 to be easily constructed to a predetermined height and width using a variety of different sized lockable boxes 14. The number of lockable boxes 14 in each lobby table 10 depends on the particular use of the table 10 and the height and width of the table 10. In the preferred embodiment, there are three horizontal rows having twelve (12) lockable boxes 14 with six (6) of the boxes 14 having a standard 9.6875 ×20.125 unit size and six (6) of the boxes 24 and 26 having a reduced 9.6875×9.375 size which is half of the standard unit size (FIG. 1). The lockable boxes 14 are preferably constructed of 0.040 inches (0.10 cm) steel.

As shown in FIG. 5, the perimeter of the front openings 14D of each of the boxes 14 is surrounded by a series of top, bottom, right and left frame members 32, 34, 36 and 38 which extend adjacent each wall 14A, 14B and 14C of the box 14. The frame members 32, 34, 36 and 38 are essentially U-shaped and are mounted over the front flanges 14F, 14G and 14H of the walls 14A, 14B and 14C of the lockable boxes 14. Preferably, the top and bottom frame members 32 and 34 are identical and therefore, only one will be described in detail (FIG. 3). The top frame member 32 is a rectangular, hollow-backed U-shaped member with closed ends which mounts over the top front flange 14F of the lockable box 14. The top frame member 32 has holes 39 for rivets 40 to secure the top frame member 32 to the top wall 14A of the lockable box 14. The bottom frame member 34 similarly mounts over the bottom front flange 14H of the lockable box 14 and is secured to the flange 14H by rivets 41 which extend through holes 43.

The right frame member 36 has a rectangular shape with an open back and closed ends (FIG. 2). The right frame member 36 also has an outer extension 36A which extends outward perpendicular to the outer side 36B of the right frame member 36 away from the interior of the lockable box 14. The outer extension 36A preferably extends the entire length of the right frame member 36. The inner side 36C of the right frame member 36 extends parallel to the outer side 36B of the frame member 36 and to the side wall 14C of the lockable box 14 when in place over the sidewall 14C of the lockable box 14 (FIG. 5). Preferably, the inner side 36C is wider than the sides of the other frame members 32, 34 and 38 to allow for the mounting of the door 50 of the lockable box 14.

The left frame member 38 of the lockable box 14 is similar to the other frame members 32, 34 and 36 in that the left frame member 38 has a hollow-backed rectangular shape with closed ends (FIG. 2). The inner side 38C of the left frame member 38 extends into the interior of the lockable box 14 and is preferably slightly wider than the opposed outer side 38D of the left frame member 38. The left frame member 38 has an inner and outer extension 38A and 38B adjacent the open back of the member 38. The inner and outer extensions 38A and 38B extend outward perpendicular to the inner and outer side 38C and 38D, respectively, of the member 38. The outer extension 38A adjacent the outer side 38D extend the entire length of the frame member 38. The inner extension 38A on the inner side 38C however does not extend completely to the top and bottom of the frame member 38 which allows the top and bottom frame members 32 and 34 to be mounted onto the top and bottom front flange 14F and 14H of the box 14 when the left frame member 38 is mounted onto the side front flange 14G.

When the lockable boxes 14 are subdivided to create two small boxes 24 and 26, an additional central frame member 42 is used. The central frame member 42 mounts over the center divider wall of the lockable boxes 14. The central frame member 42 has a shape similar to the shape of the right frame member 36. The right side (not shown) of the central frame member 42 has an extension (not shown) which extends perpendicular to the right side of the member 42 and into the right small box 24. The left side (not shown) of the central frame member 42 has added width and extends into the interior of the left small box 26, parallel to the center wall of the lockable box 14 similar to the inner side 36C of the right frame member 36. The wider left side of the central frame member 42 allows for mounting of the left small door 48A for the left small box 26. The frame members 32, 34, 36, 38 and 42 are preferably constructed from steel similar to that used to construct the lockable boxes 14.

The front openings 14D of the lockable boxes 14 are preferably closed by a lockable door 50. The door 50 is preferably mounted onto the inner side 36C of the right frame member 36. In the case of the small box 24 or 26, a left small door 48A for the left small box 26 is mounted onto the left side (not shown) of the central frame member and the right small door 48B for the right small box 24 is mounted onto the inner side 36C of the right frame member 36. Both size doors 48 and 50 are preferably mounted onto the lockable boxes 14 by a spring hinge 52 which is secured between the doors 48 or 50 and the adjacent frame member 36 or 42 by a pop rivet 54. The doors 48 and 50 of the lockable boxes 14, 24 and 26 are preferably identical except for their size and therefore only the regular sized doors 50 will be described in detail. The doors 50 are preferably rectangular and hollow-backed with an L-shaped flange 50A extending along the bottom 50B and one side 50C of the door 50 adjacent the hinge 52 (FIG. 2). The L-shaped flange 50A also extends partially along the top 50D of the door 50 stopping before the side 50E of the door 50 adjacent the locks 56 and 58. The remaining portion of the top 50D of the door 50 and the side 50E of the door 50 adjacent the locks 56 and 58 has a single flange 50F extending perpendicular to the face plate 50G of the door 50. The flanges 50A and 50F of the door 50 add durability and aesthetic quality to the door 50. Each of the doors 48 and 50 of the lockable boxes 14, 24 and 26 preferably have two independent locks 56 and 58 (FIG. 3). The first lock 56 is a simple key lock similar to those known in the art. The second lock 58 is preferably an arrow lock similar to those used in other postal boxes. In the preferred embodiment, the lockable boxes 14, 24 and 26 frame members 32, 34, 36, 38 and 42 and doors 48 and 50 are constructed from 0.045 inches (0.114 cm) steel.

To complete the aesthetic appearance of the lobby table 10, a T-shaped molding 60 is vertically mounted between vertically adjacent lockable boxes 14 (FIG. 2). The T-shaped molding 60 is inserted between the right and left frame members 36, 38 of adjacent lockable boxes 14 such that the top 60A of the T-shaped molding 60 lays on the flanges 36A and 38B of the frame members 36 and 38 (FIG. 2). The perpendicular leg 60B of the T-shaped molding 60 extends between the vertically adjacent lockable boxes 14. The T-shaped molding 60 is mounted to the lockable boxes 14 by carriage bolts (not shown). The carriage bolts are mounted through the side wall 14C of one lockable box 14 and through the leg 60B of the T-shaped molding 60 and into the side wall 14C of the vertically adjacent lockable box 14. In the preferred embodiment, the T-shaped molding 60 is only secured at the uppermost and lowermost horizontal rows of lockable boxes 14. Preferably, the T-shaped molding 60 is of a length such as to extend the entire height of the horizontal rows of lockable boxes 14. Thus, in the preferred embodiment, the T-shaped molding 60 is the same height as three horizontal rows of lockable boxes 14 including all the horizontal spacers 64 and 66. The T-shaped molding 60 is preferably constructed from steel and has a polished surface in order to enhance the physical appearance of the T-shaped molding 60.

The lockable boxes 14 are mounted together by front and back horizontal spacers 64 and 66 in a series of horizontal rows (FIG. 3). The horizontal spacers 64 and 66 also provide spacing between the boxes 14 which allows for mounting of the top and bottom frame members 32 and 34 between the horizontal rows of the boxes 14. The horizontal spacers 64 and 66 have a general U-shape with a short lower leg 64A and 66A and a long upper leg 64B and 66B. The horizontal spacers 64 and 66 are mounted between adjacent horizontal rows of lockable boxes 14 such that the long upper leg 64B and 66B of one spacer is adjacent the bottom walls 14B of the boxes 14 of one horizontal row and the short lower leg 64A and 66A of the same spacer 64 is adjacent the top walls 14A of the boxes 14 of the next lower adjacent horizontal row of boxes 14. The spacers 64 are positioned such that the legs 64A and 64B of the horizontal spacers 64 and 66 extend toward the back panel 10B of the lobby table 10. In the preferred embodiment, there are two horizontal spacers 64 and 66 between each horizontal row of lockable boxes 14. In addition, there are preferably two horizontal spacers 64 and 66 between the lowermost horizontal row of lockable boxes 14 and the base 70 of the table 10 (to be described in detail hereinafter)(FIG. 3). The front horizontal spacers 64 and 66 are mounted adjacent to and spaced inward from the front openings 14D of the lobby table 10 and the back horizontal spacers 66 are mounted adjacent the back openings 14E of the lockable boxes 14 such that the end 66C of the upper long leg 66B is flush with the back flange 14L of the bottom wall 14B of the lockable boxes 14. In the preferred embodiment, the horizontal spacers 64 and 66 extend the entire length of the horizontal rows of lockable boxes 14 from one side of the lobby table 10 to the opposed side of the lobby table 10 (FIG. 2). The continuous horizontal spacers 64 and 66 improve the structural integrity of the lobby table 10. The horizontal spacers 64 and 66 are mounted between the lockable boxes 14 parallel to the back 10B of the lobby table 10 and parallel to each other. The lockable boxes 14 are preferably mounted to the horizontal spacers 64 and 66 by rivets 18, although other fastening means such as welding can also be used. Preferably, the horizontal spacers 64 and 66 have a width of 1.9375 inches (5 cm) between the legs 64A, 64B, 66A and 66B such that the lockable boxes 14 are spaced approximately about 1 inch (2.5 cm) apart. The horizontal spacers 64 and 66 are preferably constructed of the same material as the lockable boxes 14. In the preferred embodiment, the horizontal spacers 64 and 66 are constructed of 0.060 inches (0.152 cm) steel.

As shown in FIG. 3, the base 70 of the lobby table 10 is comprised of a bottom panel 72 which is mounted on a pedestal 74. The bottom panel 72 extends between the side panels 76 of the lobby table 10 and the back edge 72A of the bottom panel 72 is flush with the back openings 14E of the lockable boxes 14. The front edge 72A of the bottom panel 72 is spaced inward from the front openings 14D and the bottom frame members 34 of the lockable boxes 14 of the lowermost horizontal row of lockable boxes 14. The bottom panel 72 is mounted adjacent the short legs 64B and 66B of the horizontal spacers 64 and 66 opposite the bottom wall 14B of the lockable boxes 14 of the lowermost horizontal row of lockable boxes 14. The pedestal 74 of the base 70 is mounted on the bottom panel 72 on the side opposite the horizontal spacers 64 and 66. The pedestal 74 is formed by a U-shaped channel having a long upper leg 74A and a short lower leg 74B. The pedestal 74 is mounted in a rectangular shape spaced inward from and around the perimeter of the bottom panel 72. In the preferred embodiment, the pedestal 74 is mounted such that the legs 74A and 74B of the channel extend inward toward the middle of the lobby table 10 with the upper leg 74A adjacent the bottom panel 72 and the lower leg 74B adjacent the ground surface (not shown). The pedestal 74 is preferably mounted such that the back 74C of the pedestal 74 is flush with the back edge 72A of the bottom panel 72 and the back openings 14E of the lockable boxes 14. The front 74D of the pedestal 74 is directly in line with the front horizontal spacer 64 spaced inward from the front openings 14D of the lockable boxes 14. The sides 74E of the pedestal 74 extend between the front and back 74D and 74C of the pedestal 74 parallel to the side panels 76 of the lobby table 10. The sides 74E of the pedestal 74 are riveted onto the front and back 74D and 74C of the pedestal 74. Preferably, the sides 74E of the pedestal 74 are mounted flush with the side panels 76 of the lobby table 10. The pedestal 74 of the base 70 is mounted such that the lockable boxes 14 overhang the base 70 at the front of the lobby table 10 (FIGS. 1 and 4). This overhang increases the aesthetic quality of the lobby table 10. In the preferred embodiment, the pedestal 74 has a height of 4 inches (10.16 cm).

The lobby table 10 has opposed side panels 76 with a back panel 77 extending therebetween adjacent the back openings 14E of the lockable boxes 14 (FIG. 2). The side panels 76 and the back panel 77 increase the aesthetic quality of the lobby table 10 by creating a uniform surface on three sides of the lobby table 10 which effectively disguises the individual lockable boxes 14 and enables the lockable boxes 14 to appear as a single complete unit. The side panels 76 of the lobby table 10 extend from the front openings 14D of the lockable boxes 14 to the back openings 14E of the boxes 14. The side panels 76 are preferably flat, rectangular panels with flanges 76A, 76B, 76C and 76D around the perimeter of the panels 76. The side panels 76 are mounted on the lobby table 10 such that the front flange 76A of one side panel 76 extends over the outer extension 38B of the left frame members 38, on one side and the front flange of the opposed side panel 76 extends over the outer extension 36A of the right frame members 36 on the opposed side. The top flange 76B of the side panels 76 extend over the top wall 14A of the outermost lockable boxes 14 of the uppermost horizontal row of locked boxes 14 between the counter top 12 and the uppermost row of lockable boxes 14. The bottom flange 76C of the side panels 76 preferably extend over the side edges 72A of the bottom panel 72 toward the sides 74E of the pedestal 74. The back flange 76D of the side panels 76 extends over the L-shaped back flange 14J of the side wall 14C of the lockable boxes 14. The side panels 76 are preferably made of a vinyl coated 16 gauge steel. The vinyl can be any color or finish depending upon the particular use for the lobby table 10.

The back panel 77 of the lobby table 10 is inserted down along the back openings 14E of the lockable boxes 14 between the back flanges 76D of the side panels 76 and the lockable boxes 14 such that the back flanges 76D of the side panels 76 act to hold the back panel 77 in place. The back panel 77 extends from the top wall 14A of the upper most horizontal row of lockable boxes 14 to the bottom panel 72 of the base 70 of the lobby table 10. The back panel 77 is held in place by rivets 20 extending through the back flanges 76D of the side panels 76 and into and through the back panel 77 and into the back flanges 14J and 14L of the lockable boxes 14.

The lobby table 10 is also provided with a side desk 78 which can be mounted onto either side panel 76 of the lobby table 10 (FIGS. 1 and 4). The side desk 78 has a desk top 80 which is supported by a support shell 82. The support shell 82 has a back 82A and an outer leg 82B which are formed together by a two panel construction and which provides for an open front 82C. An outer panel 82D forms the outer side of the support shell 82. The end of the leg 82B has a double flange 82E which forms a square corner at the open front 82C of the side-desk 78. The opposite end of the outer panel 82D has a single flange (not shown) which is fastened to the side panel 76 of the lobby table 10. The inner panel (not shown) is mounted adjacent to the inner surface of the outer panel 82D and is fastened onto the two flanges 82E of the outer panel 82D. Preferably, the inner and outer panels 82D are fastened together by pop rivets (not shown). The side desk 78 is mounted to the side panel 76 of the lobby table 10 by angle brackets (not shown). One leg of the brackets is riveted to the side panel 76 and the other leg of the brackets is mounted to the side desk 78. In the preferred embodiment, there are two angle brackets, the horizontal bracket is mounted horizontally, parallel to the counter top 12 and the vertical bracket is mounted vertically on the side panel 76 adjacent the back panel 77 of the lobby table 10. The side desk 78 is mounted onto the brackets with the desk top 80 adjacent the horizontal bracket and the back 82A of the support shell 82 adjacent the vertical bracket. The side desk 78 is then fastened to the brackets by rivets to secure the side desk 78 to the side panel 76 of the lobby table 10. The side desk 78 is constructed such that the desk 78 can be mounted to either side panel 76 of the lobby table 10 by rotating the support structure 82 180° such that the top of the support structure 82 becomes the bottom of the support structure 82. The side desk 78 is mounted to the lobby table 10 such that the desk top 80 of the side desk 78 is spaced below the counter top 12 of the lobby table 10. The lower desk top 80 and the open front 82C of the side desk 78 allow a handicap person in a wheelchair to maneuver the wheelchair into the open front 82C of the side desk 78 beneath the desk top 80 in order to position themselves adjacent the desk top 80 which enables them to easily use the lower desk top 80 of the side desk 78. In the preferred embodiment, the desk top 80 is similar in shape and construction except for being smaller in size to the counter top 12 of the lobby table 10. The desk top 80 of the side desk 78 is preferably constructed from a high pressure laminate similar to that used to construct the counter top 12 of the lobby table 10. The support structure 82 is preferably constructed from vinyl coated 16 gauge steel similar to that used to construct the side panels 76 of the lobby table 10.

To construct the lobby table 10, the counter top 12 is first placed face down on a building surface (not shown) such that the back stop 12B extends over the edge of the building surface in order to allow the counter top 12 to lay flat during the assembly of the lobby table 10. Next, the lockable boxes 14 with their frame members 32, 34, 36, 38 and 42 which are to form the uppermost horizontal row of lockable boxes 14 are positioned on the underside of the counter top 12. The lockable boxes 14 are positioned such that the back flanges 14J and 14L of the lockable boxes 14 are almost flush with the back edge 72A of the counter top 12 while the front openings 14D of the lockable boxes 14 are spaced inward from the front edge 72B of the counter top 12 which allows the counter top 12 to overhang the front openings 14D of the lockable boxes 14. The lockable boxes 14 are then secured to the underside of the counter top 12. In the preferred embodiment, the lockable boxes 14 are riveted to the counter top 12. The T-shaped moldings 60 are then inserted vertically between the vertically adjacent lockable boxes 14 and are secured into place by bolting to the two adjacent lockable boxes 14. Next, the horizontal spacers 64 and 66 are mounted by rivets 18 onto the bottom wall 14B of the lockable boxes 14 of the uppermost horizontal row of lockable boxes 14. The top walls 14A of the next lower horizontal row of lockable boxes 14 are then mounted on the horizontal spacers 64 and 66. The top walls 14A are fastened to the horizontal spacers 64 and 66 similarly to the fastening of the bottom walls 14B of the uppermost row to the horizontal spacers 64 and 66. Each additional lower row of lockable boxes 14 is mounted as described above. Once the lowermost row of lockable boxes 14 has been mounted, the T-shaped moldings 60 are fastened to the vertically adjacent lockable boxes 14 of the lowermost row of lockable boxes 14. The last horizontal spacers 64 and 66 are then mounted to the bottom wall 14B of the lockable boxes 14 of the lowermost row of lockable boxes 14. Next, the bottom panel 72 of the base 70 is mounted onto the horizontal spacers 64 and 66 and riveted into place. The pedestal 74 is then fastened onto the bottom panel 72 opposite the lockable boxes 14. The side panels 10A are then slipped onto the ends of the lobby table 10. The side panels 10A are temporarily held in place due to the top flange 76B of the side panel 76 inserted between the counter top 12 and the top wall 14A of the lockable boxes 14 of the uppermost horizontal row of lockable boxes 14. Finally, the back panel 77 is slid down adjacent the back openings 14E of the lockable boxes 14 beneath the back flanges 76D of the side panels 76. The side panels 76 are then riveted to the back panel 77 and preferably to the underlying lockable boxes 14 in order to secure the back panel 77 and the side panels 76 in place. In the preferred embodiment, the side desk 78 is then mounted to one of the side panels 76 of the lobby table 10.

In use, the lobby table 10 with the side desk 78 is positioned in a lobby of a post office. In the preferred embodiment, the lobby table 10 is positioned such that the back panel 77 of the lobby table 10 is adjacent a wall of the lobby (FIG. 1). Alternately, two similarly sized and shaped lobby tables 10 with similarly positioned side desks 78 can be positioned back-to-back in the middle of the post office lobby (FIG. 4). To use the lockable boxes 14, the postal worker opens the lockable box 14 using a universal key which fits all of the second locks 58 on each of the lockable boxes 14. The postal worker then removes the key (not shown) from the first lock 56 of the lockable box 14 and places that key in the mailbox (not shown) of the person whom owns the mail delivered to the lockable box 14. When the person retrieves the mail, he inserts the key from his mailbox into the first lock 56 of the lockable box 14 and removes his mail from the lockable box 14. The first lock 56 is designed to maintain possession of the key once the key has been reinserted into the first lock 56 of the lockable box 14. Thus, the lobby table 10 allows larger parcels of mail to be delivered to a person having a mailbox without the need for that person to permanently maintain a larger mailbox. In addition, the lobby table 10 with the side desk 78 provides a writing surface for postal customers including those who are in a wheelchair within the lobby while effectively utilizing the space beneath the lobby table 10 for additional mail delivery.

Numerous variations will occur to those skilled in the art. It is intended that the foregoing descriptions be only illustrative of the present invention and that the present invention be limited only by the hereinafter appended claims.

I claim:

1. A lobby table having a top, a bottom and two opposed sides for use in a post office lobby, which comprises:

(a) lockable boxes each having a top wall and a bottom wall with two sidewalls therebetween forming a rectangular opening spaced between a front opening and a back opening and with a frame means mounted around the front opening of each of the lockable boxes wherein the lockable boxes are positioned in vertically adjacent horizontal rows and in vertical rows positioned one above the other;

(b) horizontally oriented spacers mounted between each of the vertically adjacent horizontal rows of the lockable boxes and secured to the top wall and the bottom wall of the lockable boxes with a first spacer adjacent the front opening and a second spacer adjacent the back opening of each of the lockable boxes;

(c) vertically oriented moldings mounted between each of the vertical rows of the lockable boxes;

(d) lockable door means mounted adjacent the front opening of each of the lockable boxes for allowing closing of the front opening of each of the lockable boxes;

(e) a counter top means mounted adjacent the top wall of the lockable boxes of an uppermost horizontal row of the lockable boxes at a height which enables the table to be used as a desk;

(f) a base means mounted adjacent the bottom wall of the lockable boxes of a lowermost horizontal row of the lockable boxes for supporting the lockable boxes above a ground surface; and (g) a back panel means mounted adjacent the back openings of each of the lockable boxes for closing the back openings of each of the lockable boxes.

2. The lobby table of claim 1 wherein a desk means is mounted adjacent to one of the opposed sides of the lobby table for use by a handicap user.

3. The lobby table of claim 2 wherein the desk means has a desk top means, an outside leg and a back wall which form an open front to enable the handicap user in a wheelchair to move a portion of the wheelchair under the desk top means.

4. The lobby table of claim 1 wherein the lockable boxes, spacers and moldings are constructed of steel.

5. The lobby table of claim 1 wherein the horizontal oriented spacers are secured by rivets to the bottom wall of the lockable boxes.

6. The lobby table of claim 1 wherein there are between about 3 and 6 lockable boxes in the uppermost horizontal row for accepting letter sized objects.

7. The lobby table of claim 6 wherein the lockable boxes of the lowermost horizontal row are twice the length as the lockable boxes of the uppermost horizontal row.

8. The lobby table of claim 1 wherein there are between about 3 and 6 lockable boxes in the lowermost horizontal row which accept parcel sized objects.

9. The lobby table of claim 1 wherein there are three lockable boxes in each vertical row.

10. The lobby table of claim 1 wherein the vertically oriented moldings have a length such as to extend from the counter top means downward to the base means.

11. The lobby table of claim 10 wherein the vertically oriented moldings are T-shaped.

12. The lobby table of claim 11 wherein the vertically oriented moldings are constructed of polished steel.

13. The lobby table of claim 1 wherein the horizontally oriented spacers are U-shaped having a long leg and a short leg and are mounted such that the long leg is adjacent the bottom wall of the lockable boxes of one horizontal row of lockable boxes and the short leg is adjacent the top wall of a the lockable boxes of next vertically adjacent horizontal row of lockable boxes.

14. A method for manufacturing a lobby table having a top, a bottom and two opposed sides, which comprises:

(a) providing lockable boxes each having a top wall and a bottom wall with two sidewalls therebetween forming a rectangular opening spaced between a front opening and a back opening and having a frame means mounted around the front opening of each of the lockable boxes, horizontally oriented spacers, lockable door means mounted on the frame means for allowing closing of the front opening of each of the lockable boxes, a counter top means having a top surface and a bottom surface with a front edge and a back edge and two ends extending therebetween for enabling the table to be used as a desk, a base means for supporting the lockable boxes above a ground surface, a back panel means for closing the back openings of the lockable boxes;

(b) positioning the counter top means with the bottom surface facing upwards;

(c) mounting the top wall of the lockable boxes of an uppermost row of the lockable boxes on the bottom surface of the counter top means so that the front opening of the lockable boxes is adjacent the front edge of the counter top means;

(d) securing horizontally oriented spacers on the bottom wall of the lockable boxes of the uppermost row of the lockable boxes opposite the counter top means;

(e) mounting at least two horizontal rows of the lockable boxes spaced apart by horizontally oriented spacers with the top wall of the lockable boxes of an adjacent horizontal row of the lockable boxes on the horizontally oriented spacers opposite the lockable boxes of the uppermost row, wherein the front opening of the lockable boxes of the uppermost row is adjacent the front opening of the lockable boxes of the horizontal rows of the lockable boxes;

(f) mounting the base means on the bottom wall of the lockable boxes of a lowermost row of lockable boxes; and (g) mounting the back panel adjacent the back opening of the lockable boxes for closing the back opening of the lockable boxes.

15. The method of claim 14 wherein after step (g) side panel means are mounted adjacent opposed sides of the table adjacent the lockable boxes.

16. The method of claim 15 wherein a desk means having a desk top, an outside leg and a back wall is mounted on one of the side panel means of the table for use by a handicap user.

17. The method of claim 14 wherein in step (d) the horizontally oriented spacers are secured to the lockable boxes by rivets.

* * * * *